United States Patent [19]

Moore

[11] Patent Number: 4,579,134

[45] Date of Patent: Apr. 1, 1986

[54] LIPSTICK CONTAINER

[75] Inventor: Arthur H. Moore, Fairfield, Conn.

[73] Assignee: The Bridgeport Metal Goods Manufacturing Co., Bridgeport, Conn.

[21] Appl. No.: 361,855

[22] Filed: Mar. 25, 1982

Related U.S. Application Data

[63] Continuation of Ser. No. 831,371, Sep. 8, 1977, abandoned, Continuation-in-part of Ser. No. 784,554, Apr. 4, 1977, abandoned.

[51] Int. Cl.[4] ..... A45D 40/30

[52] U.S. Cl. ..... 132/88.5; 401/59; 132/79 E

[58] Field of Search ..... 132/79 C, 85.5, 88.7; 401/192, 194, 52, 59; 206/56, 581, 385

[56] References Cited

U.S. PATENT DOCUMENTS

| | | | |
|---|---|---|---|
| 2,367,992 | 1/1943 | Berls | 35/59 |
| 2,590,329 | 3/1952 | Kromray | 132/79 C |
| 2,678,128 | 5/1954 | Sherman | 206/385 |
| 3,175,680 | 3/1965 | Fuglsang-Madsen et al. | 206/56 |
| 3,214,012 | 10/1965 | Mack | 206/385 |
| 3,991,777 | 11/1976 | Powers et al. | 132/88.7 |

FOREIGN PATENT DOCUMENTS

| | | |
|---|---|---|
| 1752118 | 7/1957 | Fed. Rep. of Germany . |
| 1501633 | 11/1967 | France . |
| 340019 | 9/1959 | Switzerland . |

*Primary Examiner*—Gregory E. McNeill

*Attorney, Agent, or Firm*—Cifelli, Frederick & Tully

[57] ABSTRACT

A lipstick container comprising a cylinder having a rotatable knob on one end and an opening at the opposite end. The cylinder is comprised of an opaque lower section and a transparent shield which extends from the top of the lower section to the cylinder opening. A lipstick is movably disposed inside the cylinder. The relative position of the lipstick with respect to the cylinder is controlled by rotation of the knob, and for application, the lipstick is moved so that a top portion of the lipstick extends outside the cylinder. For storage, the lipstick is selectively moved to its lowest position so that all of the lipstick is inside the cylinder below the level of the opening. In this storage position, the top portion of the lipstick remains above the lower section of the cylinder and, therefore, is visible through the transparent shield. In this storage position, a transparent cover is put on over the cylinder and the shield protects the lipstick from coming in contact with the cover. In addition, as both the cover and shield are transparent, the color of the lipstick can be determined without the need for removing the cover and moving the lipstick.

15 Claims, 6 Drawing Figures

Fig. 1.
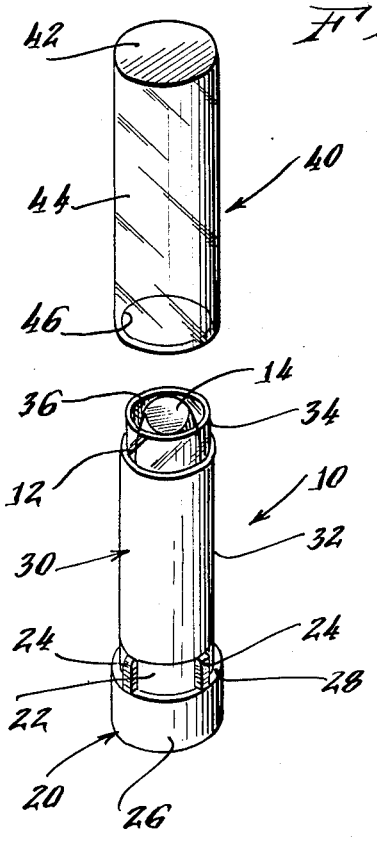
Fig. 2.
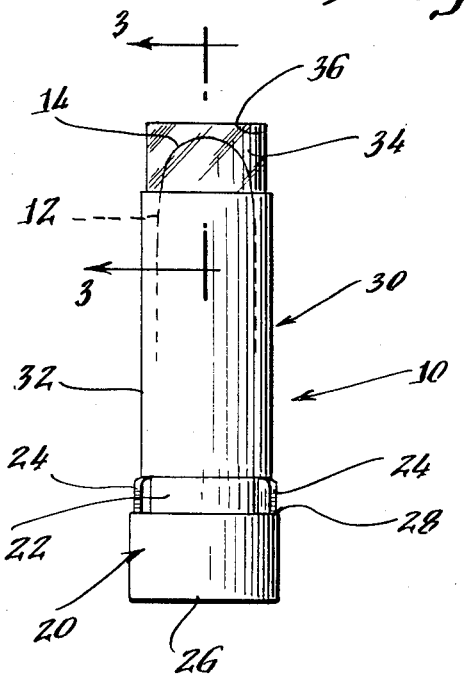
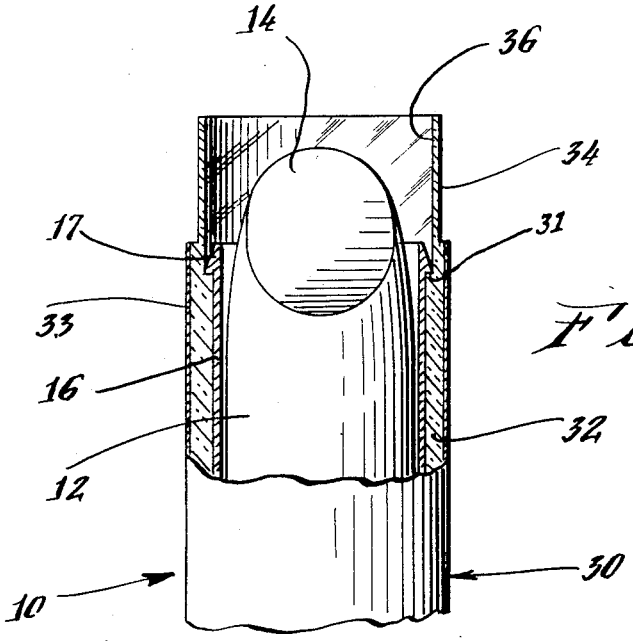
Fig. 3.

LIPSTICK CONTAINER

This application is a continuation of Ser. No. 831,371 filed Sept. 8, 1977 which is a continuation-in-part of Ser. No. 784,554, filed Apr. 4, 1977 , both are now abandoned.

BACKGROUND OF THE INVENTION

This invention relates to an improvement in a type of lipstick container which is commonly used in the cosmetic field.

The prior art lipstick container generally comprises a cylinder having a rotatable knob disposed at its bottom end. A lipstick is mounted inside and extends out of the top of the cylinder. Rotation of the knob causes a mechanism in the cylinder to move the lipstick longitudinally. In this manner, the lipstick is placed in its uppermost position with a large amount of the lipstick exposed for application and returned to its lowest position with respect to the cylinder for storage.

The knob has a tubular slide extending upwardly therefrom, and the tubular slide is provided with vertical slots. The cylinder is rotatably mounted surrounding the tubular slide, and the cylinder includes an outer spiral member having spiral slots formed on its interior surface adjacent the tubular slide. A cup member is slidably mounted in the tubular slide and has posts which protrude through the slots of the tubular slide and into the spiral slots of the outer spiral member. The lipstick is received in the cup. Thus, the cup is secured against rotation with respect to the tubular slide, and rotation of the cylinder relative to the knob and tubular slide causes the posts of the cup to travel up the spiral slots of the outer spiral member, raising or lowering the lipstick according to the direction of rotation.

It is desirable to be able to determine the color of the lipstick without opening the lipstick container, and therefore, when the lipstick is in its lowest position, the top portion of the lipstick extends outside the cylinder in the prior art lipstick container. A clear plastic cap is also provided which generally extends from above the top of the exposed lipstick down the sides of the cylinder to the knob. Consequently, when the cap is in place, the color of the lipstick can be seen by observing through the transparent cover that top portion of the lipstick which is out of the cylinder.

A major drawback of this type of lipstick container is that when the cap is being reinserted after an application of the lipstick, the lower portion of the cap may contact the exposed top portion of the lipstick unless the user is extremely careful. As the lipstick is by design soft and easily transferred on contact to another surface, the lipstick is transferred in this manner to the inside of the cap. As the cap is placed on the container, the residual lipstick already transferred to inside the cap is smeared over the sides of the cylinder. This is not only wasteful and aesthetically displeasing, but also results in the residual lipstick being transferred from the cylinder to the fingers of the user upon subsequent use. Of course, after repeated use of this prior art lipstick container, this condition and its effects become progressively worse. As a result, the prior art lipstick containers of this type inherently create a great deal of waste and mess but, nevertheless, are well-known and widely used.

SUMMARY OF THE INVENTION

A lipstick container according to the invention herein protects its lipstick and prevents the resultant mess and waste found with the prior art devices, and yet provides the advantageous feature of showing the color of the lipstick without removing the cover.

The improved lipstick container comprises a cylinder having a rotatable knob disposed at its bottom end and a lipstick opening at its top end. A lipstick is disposed inside the upper portion of the cylinder, and rotation of the knob causes a mechanism (similar to the prior art) inside the cylinder to move the lipstick longitudinally with respect to the cylinder. The lipstick may be moved to its highest position so that it is exposed out of the opening for application and correspondingly moved to its lowest position with respect to the cylinder for storage. In its lowest position, the lipstick is entirely inside the cylinder. The lipstick container also has a transparent cylindrical cover which fits over the cylinder and when in place extends down as far as the knob.

The cylinder itself is comprised of two sections. The lower section, extending from the knob to the upper section, is opaque and comprises the lipstick-moving mechanism. It covers a large portion of the lipstick itself when the lipstick is in its lowest position. The upper section is a transparent shield and extending upwardly from the lower section to the lipstick opening. The transparent shield surrounds the uppermost portion of the lipstick when the lipstick is in its storage position, and protects the lipstick from coming into contact with the cover when the cover is being put in place over the cylinder. Therefore, the transparent shield prevents the cover and, consequently, the cylinder from becoming smeared with lipstick as in the prior art devices. Further, due to the transparency of the shield, the color of the lipstick can still be determined when the cover is in place which is commercially and practically desirable.

The shield can be made as a part of an entire transparent cylinder. In this case, the lower portion of the cylinder would be covered with a strip of metal, silvered or otherwise colored to make it opaque, while the shield would not be so covered and would still remain transparent. Further, the cylinder may comprise an opaque lower section, preferably metal, and a separate transparent shield attached to its end opposite the knob of the lipstick container.

Accordingly, a principal object of the present invention is to provide an improved lipstick container which prevents smearing of lipstick when its cover is removed or replaced and at the same time permits the color of the lipstick to be determined without the need for removing the cover.

Other and more specific objects of the present invention will be in part obvious and will in part appear from the following description of the preferred embodiments and claims taken together with the drawings.

DRAWINGS

FIG. 1 is a perspective view of a lipstick container according to the invention herein;

FIG. 2 is an enlarged side view of the lipstick container of FIG. 1 without its cover;

FIG. 3 is an enlarged cross-sectional view of the lipstick container of FIG. 1 taken along lines 3—3 of FIG. 2;

The same reference numbers refer to the same elements throughout the various Figures.

DESCRIPTION OF THE PREFERRED EMBODIMENTS

Figure 4:
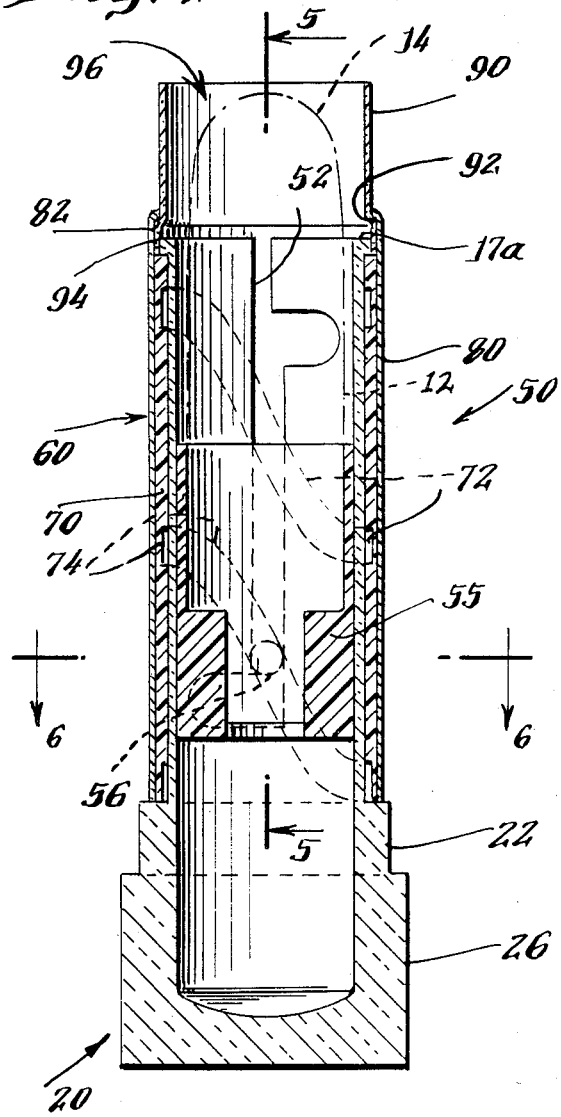
FIG. 4 is a cross-sectional view of another lipstick container according to the invention herein.

Referring now to FIG. 1, a lipstick container according to the invention herein is shown at 10. The lipstick container 10 generally comprises three main elements which are a rotatable knob 20, a cylinder 30 and a protective cover 40.

As shown in FIG. 1, the rotatable knob 20 comprises a small disc 22 concentrically mounted upon a larger disc 26 thereby forming a lip 28. The small disc 22 has several bumps 24 disposed at intervals on its side. A tubular slide liner 16 extends upwardly from knob 20, as seen in FIG. 3.

The cylinder 30 is rotatably mounted with respect to and extends upwardly from the top of the small disc 22. In particular, the cylinder 30 rotatably surrounds the tubular slide liner 16 extending upwardly from knob 20. The cylinder 30 is concentrically positioned wih respect to the small disc 22 and the outer diameter of the cylinder 30 and the diameter of the small disc 22 are substantially the same. As best shown in FIG. 2, the cylinder 30, which is made of a transparent material, has a lower section 32 which extends from the knob 20 to a shield 34. The outside of the lower section 32 is covered with a silver coating 33, as shown in FIG. 3, which is attached by a hot stamp process, thereby making the lower section 32 of the cylinder 30 nontransparent. In the alternative, the lower section 32 may be made opague by painting it or covering it with plate. As shown in FIG. 3, the lower section 32 has a lip 31 disposed on its inside near the shield 34. The tubular slide liner 16 is positioned inside the lower section 32 of cylinder 30 so that the outside of the tubular slide liner 16 is adjacent to the inside of the lower section 32. The tubular slide liner 16 has a flange 17 at its upper end and the flange 17 rests on the lip 31 of the lower section 32, securing the cylinder 30 longitudinally with respect to the knob 20 and tubular slide liner 16, but permitting rotation of the cylinder 30 about the tubular slide liner 16.

The cylindrical shield 34 extends from the lower section 32 to the end of the cylinder 30 opposite the knob 20. The shield 34 is transparent, as noted above, and forms a lipstick opening 36 at the end of the cylinder 30 opposite the knob 20. As best shown in FIG. 3, the outer diameter of the transparent shield 34 is somewhat less than that of the lower section 32, which facilitates coating the lower section 32. The inner diameter of the shield 34 is the same as that of the lip 31 of the lower section 32.

The cylinder 30 houses a lipstick 12 located inside the tubular slide liner 16 and supported in a cup (not shown) having posts which extend through vertical slots in the tubular slide liner 16 and into spiral grooves formed on the interior of lower section 32 of cylinder 30, whereby the lipstick 12 moves longitudinally with respect to the cylinder 30 upon rotation of the knob 20. This mechanism is a well-known one in the lipstick art, but will be discussed in more detail in describing the second preferred embodiment of the invention.

The lipstick 12 is substantially cylindrical and concentrically disposed inside the cylinder 30 and the tubular slide liner 16, and as the lipstick 12 has a diameter less than that of the lipstick opening 36, it can pass therethrough. In operation, the knob 20 is rotated so that the lipstick 12 moves away from the knob 20 and a large portion of the lipstick 12 becomes exposed through the opening 36 and positioned above the transparent shield 34 of the cylinder 30. The lipstick 12 is then in its uppermost position and can be applied. After the lipstick 12 has been used, the knob 20 is rotated in the opposite direction thereby moving the lipstick 12 back entirely inside the cylinder 30. When the lipstick 12 is in place inside the cylinder 30, in its lowest or storage position, a topmost portion 14 of the lipstick 12 is disposed below the transparent shield opening 36 but above the opaque lower section 32 of the cylinder 30. This portion 14 of the lipstick 12 is therefore visible through the transparent shield 34, as best shown in FIG. 2.

As shown in FIG. 1, the protective cover 40 is also transparent and comprises a circular top 42 having a cylindrical sidewall 44 peripherally disposed thereon and extending downwardly therefrom. The sidewall 44 is slightly longer than the cylinder 30 and forms a bottom opening 46 opposite the top 42. The inside diameter of the cover 40 is greater than that of the outside diameter of the lower section 32 of the cylinder 30, and the cover 40 is therefore put on the cylinder 30 by inserting the shield end of the cylinder 30 through the cover bottom opening 46. The cover 40 then slides down the cylinder 30 so that the cover sidewall 44 surrounds and contacts the entire lower section 32 and the small disc 22 of the knob 20. The cover 40 has a smaller diameter than that of the larger disc and therefore cannot pass over the entire knob 20. The cover 40 is held in place by a force or friction fit between the bumps 24 of the small disc 22 and the inside of the sidewall 44 near the opening 46.

When the cover 40 is in place, it extends from the lip 28 of the rotatable knob 20 to above the transparent shield 34. As both the cover 40 and the shield 34 are transparent, the top portion 14 of the lipstick 12 can still be seen and its color determined without the need for removing the cover 40. At the same time, as long as the top portion 14 of the lipstick 12 is in its storage position below the lipstick opening 36, it is protected by the shield 34 from any contact with the cover 40. Because of the shield 34, the lower portion of the cover sidewall 44 at the bottom opening 46 cannot strike the top portion 14 of the lipstick 12 as the cover 40 is being put over the cylinder 30. As a result, the lipstick 12 will not be accidentally transferred to the cover 40 and thereby smear the silver coating 33 of the lower section 32 as the sidewall 44 slides down over the cylinder 30.

Figure 5:
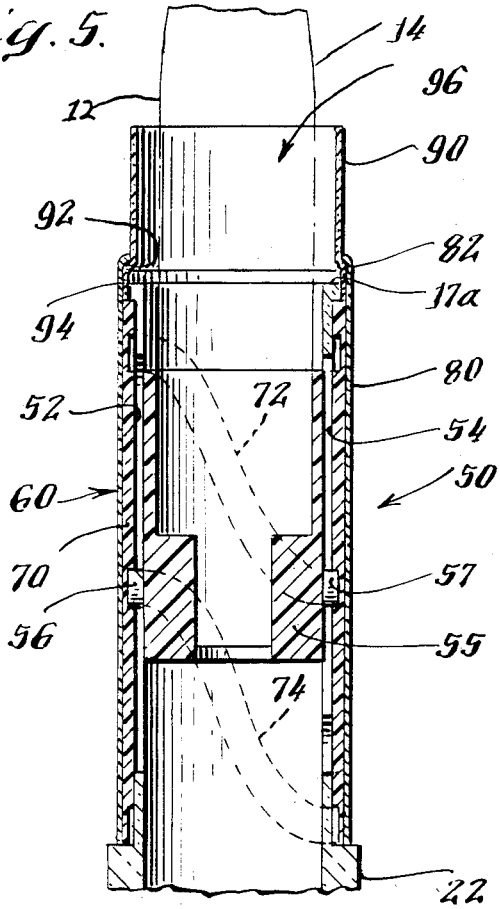
FIG. 5 is a cross-sectional view of the lipstick container of FIG. 4 taken along the lines 5—5 of FIG. 4.
Figure 6:
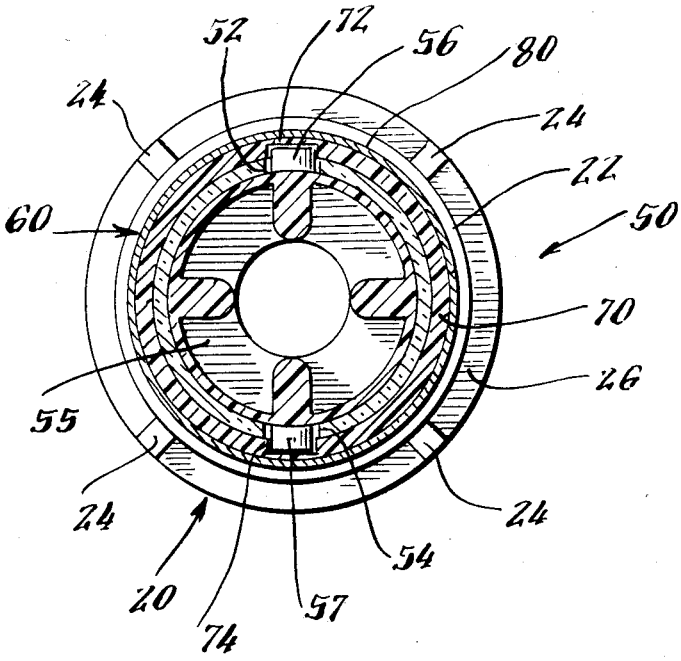
FIG. 6 is a sectional view of the lipstick container of FIG. 4 taken along the lines 6—6 of FIG. 4.

Another lipstick container 50 according to the invention herein is shown in FIGS. 4–6. The lipstick container 50 is characterized by the cylinder being comprised of a metal outer case surrounding a spiral member, and the transparent shield being a separate piece attached thereto.

More particularly and with reference to FIG. 4, the lipstick container 50 has a knob 20 integrally comprised of large disc 26 and a smaller disc 22. The small disc 22 has radially protruding bump projections 24 which extend to the diameter of the larger disc 26, as best seen in FIG. 6. A tubular slide liner 16 is integral with and extends upwardly from the knob 20. Two vertical slots, including slot 52 seen in FIG. 4 and a similar slot 54 seen in FIGS. 5 and 6, are provided in the tubular slide liner 16. The slot 52 extends to the top of the tubular slide liner 16 and extends through the flange 17*a* at the top thereof. Except for a slight difference in the configuration of the flange 17*a*, the knob 20 and tubular slide liner 16 are the same as found in the lipstick container 10 described above, and more detail of the vertical slots therein is shown in FIGS. 4–6 than in FIGS. 1–3.

A cylinder 60 is rotatably mounted to the knob 20. Cylinder 60 comprises an outer spiral member 70, which surrounds the tubular slide liner 16 and is captured between the small disc 22 of knob 20 and the flange 17*a* at the upper end of the tubular slide liner 16. The slot 52 extending through the flange 17*a* permits the flange to contract so that it can be passed through the outer spiral member 70 for assembly. Thus, the outer spiral member is held against longitudinal movement with respect to the tubular slide liner 16, but is free to rotate thereabout. The outer spiral member 70 includes double-lead spiral slots 72 and 74 formed in its inner surface adjacent the tubular slide liner 16.

The cylinder 60 further comprises a metal outer case 80, which is, of course, opaque. The metal outer case 80 is also cylindrical, and the outer spiral member 70 fits inside the metal outer case and is secured thereto by a friction-press fit. The metal outer case 80 is somewhat longer than the tubular slide liner 16, and extends above the flange 17*a* of the tubular slide liner 16. Metal outer case 80 has an inwardly turned rolled lip 82 at its upper end.

Cylinder 60 further comprises a cylindrical transparent shield 90, which is secured to and extends upwardly from the metal outer case 80. In particular, the transparent shield 90 has a radially protruding flange 92 which is received under the inwardly rolled lip 82 at the upper end of the metal outer case 80. A depending skirt 94 extends downwardly from the flange 92, and the lower end of skirt 94 butts against the top of the outer spiral member 70. Thus, the skirt 94 is press fit inside the metal outer case and the outer spiral member supports the skirt against being displaced, wherein the transparent shield 90 is well secured in the shown position. The transparent shield 90 is thinner than the outer spiral member 70, wherein a portion of the top of the outer spiral member is exposed and received under the lip of flange 17*a* so that the flange captures the outer spiral member, as described above.

The transparent shield 90 defines an opening 96 at the uppermost end of the cylinder 60.

A lipstick 12 is carried in a cup 55, and the cup 55 is slidably received in the tubular slide liner 16. The cup 55 has posts 56 and 57 which extend through the slots 52 and 54 in the tubular slide liner 16 and are received, respectively, in the double-lead spiral slots 72 and 74 of the spiral outer member 70. Thus, when the cylinder 60 is rotated with respect to the knob 20 and the tubular slide liner 16, the cup 55 is secured against rotation with respect to the tubular slide liner 16, and is carried up or down in the spiral slots 72–74 of the outer spiral member 70, depending on direction of rotation. In an upper position shown in FIG. 5, the lipstick 12 extends above the opening 96 for application. In a lower position shown in FIG. 4, the lipstick is positioned below the opening 96, but is visible through the transparent shield 90.

A cover 40, not shown in FIGS. 4–6 but shown in FIG. 1, is fitted over the cylinder 60 and held in place by friction fit with the protruding bumps 24 of the knob 20. The cover 40 is transparent, and thus the color of the lipstick 12 can be ascertained by viewing through the transparent cover 40 and the transparent shield 90 without removal of the cover. The transparent shield 90 protects the lipstick from coming in contact with the cover as the cover is removed and replaced.

From the foregoing description of the invention and the discussion of the prior art, the numerous advantages and improvements incident to this invention will now be apparent to those skilled in the art.

Accordingly, the above description of the invention is to be construed as illustrative only rather than limiting. The invention is limited only by the scope of the following claims.

I claim:

1. An improvement in a lipstick container of the type having a knob, a cylinder comprised of an opaque cylinder section rotatably mounted with respect to said knob and extending upwardly therefrom, said opaque cylinder section defining an opening opposite said knob, a colored lipstick disposed in said opaque cylinder section and mounted for longitudinal movement with respect thereto upon rotation of said knob, said lipstick movable between an upper position wherein a substantial portion of the lipstick extends from said opaque cylinder section for application and a lower position wherein an end portion of said lipstick normally extends from said opaque cylinder section to be visible for ascertaining the color of the lipstick, and a cover removably positioned over said opaque cylinder section and lipstick, at least a portion of said cover being transparent for ascertaining the color of the lipstick without removing the cover, the improvement comprising the cylinder further including a transparent shield section extending from the opaque section opposite said knob, the transparent shield section defining an opening permitting the lipstick to be extended to its upper position above the transparent shield section for application, said transparent shield section surrounding the end portion of the lipstick when said lipstick is in its lower position, thereby protecting the lipstick from contact with said cover as it is removed and replaced, and yet permitting the color of the lipstick to be ascertained by viewing through the cover and the transparent shield section when the cover is positioned over said cylinder and lipstick.

2. An improved lipstick container as defined in claim 1 wherein said transparent shield section is cylindrical and concentrically aligned with said opaque cylinder section.

3. An improved lipstick container as defined in claim 1 wherein said transparent shield section and said opaque section of said cylinder are fabricated of a single piece of transparent material and the outside of said opaque section being covered with an opaque coating to make it opaque.

4. An improved lipstick container as defined in claim 3 wherein said opaque coating is a metalized coating attached by a hot stamp process.

5. An improved lipstick container as defined in claim 4 wherein said opaque section has a greater outer diameter than said transparent shield section, thereby facilitating hot stamp coating of the opaque section without coating the transparent shield section.

6. A lipstick container comprising:

(A) a knob;

(B) a tubular slide liner extending from said knob, the tubular slide liner having at least one longitudinal slot formed therethrough;

(C) a cylinder mounted surrounding said tubular slide liner for rotation with respect to said knob, the cylinder having a first end positioned adjacent said knob and a second end spaced apart from said knob, said cylinder also having (1) an opaque section surrounding the tubular slide liner and having at least one spiral slot on its interior surface adjacent the tubular slide liner, and (2) a transparent shield section extending from the opaque section toward the section end of the cylinder spaced apart from said knob, said transparent shield section defining an opening aligned with the tubular slide liner; and (D) a cup carrying a lipstick, said cup received in said tubular slide liner and having at least one post extending through the slot in the tubular slide liner and into the spiral slot in said cylinder, whereby rotation of the cylinder relative to said knob moves said lipstick between an upper position exposing said lipstick above said transparent shield section for application and a lower position wherein said lipstick is surrounded and protected by said transparent shield section with the color of the lipstick ascertainable by viewing through said transparent shield section.

7. A lipstick container as defined in claim 6 and further comprising a cover removably positioned over said cylinder, said cover having a transparent portion positioned adjacent to said transparent shield section when said cover is positioned over said cylinder, whereby the color of the lipstick is ascertainable by viewing through said transparent shield section and the transparent portion of said cover, and the transparent shield section protects the lipstick during removal and replacement of said cover.

8. A lipstick container as defined in claim 7 wherein said cover is entirely transparent.

9. A lipstick container as defined in claim 7 wherein said cover is removably secured in place by a friction fit with said knob.

10. A lipstick container as defined in claim 6 wherein said cylinder is fabricated of a single piece of transparent material, and with an opaque coating on the section surrounding the tubular slide liner.

11. A lipstick container as defined in claim 10 wherein said opaque coating is a metalized coating applied by a hot stamp process.

12. A lipstick container as defined in claim 11 wherein the transparent shield section of said cylinder is stepped inwardly from said metalized opaque coated section, thereby facilitating application of the metalized opaque coating by hot stamping.

13. A lipstick container as defined in claim 6 wherein the opaque section of said cylinder is comprised of a metal outer case surrounding a spiral outer member having the at least one spiral groove formed on its interior surface.

14. A lipstick container as defined in claim 13 wherein said transparent shield section is press fit into said metal outer case.

15. A lipstick container as defined in claim 14 wherein said metal outer case has an inwardly turned rolled lip at its upper end and said transparent shield section includes a radially protruding flange received under said inwardly turned rolled lip and a skirt depending from said flange, said skirt being press fit into said metal outer case and said skirt butting against the outer spiral member which thereby supports the transparent shield section in said metal outer case.

* * * * *